US008913884B2

(12) United States Patent
Kim et al.

(10) Patent No.: US 8,913,884 B2
(45) Date of Patent: Dec. 16, 2014

(54) HEATER BLOCK FOR A RAPID THERMAL PROCESSING APPARATUS

(75) Inventors: Chang Kyo Kim, Hwaseong-si (KR); Tae Jong Ki, Suwon-si (KR); Choul Soo Kim, Hwaseong-si (KR); Ki Nam Kim, Suwon-si (KR)

(73) Assignee: AP Systems Inc., Gyeonggi-Do (KR)

( * ) Notice: Subject to any disclaimer, the term of this patent is extended or adjusted under 35 U.S.C. 154(b) by 397 days.

(21) Appl. No.: 13/391,410

(22) PCT Filed: Aug. 4, 2010

(86) PCT No.: PCT/KR2010/005119
§ 371 (c)(1),
(2), (4) Date: May 3, 2012

(87) PCT Pub. No.: WO2011/021796
PCT Pub. Date: Feb. 24, 2011

(65) Prior Publication Data

US 2012/0207456 A1 Aug. 16, 2012

(30) Foreign Application Priority Data

Aug. 21, 2009 (KR) ..... 10-2009-0077425

(51) Int. Cl.
*F26B 3/30* (2006.01)
*H05B 3/74* (2006.01)

(52) U.S. Cl.
CPC ..... *H05B 3/744* (2013.01)
USPC ..... 392/411; 392/407; 392/418

(58) Field of Classification Search
None
See application file for complete search history.

(56) References Cited

U.S. PATENT DOCUMENTS

| | | | | |
|---|---|---|---|---|
| 5,654,904 | A * | 8/1997 | Thakur | 702/137 |
| 6,164,816 | A * | 12/2000 | Aderhold et al. | 374/1 |
| 6,414,834 | B1 * | 7/2002 | Weldon et al. | 361/234 |
| 7,173,216 | B2 * | 2/2007 | Ptak | 219/390 |
| 7,176,417 | B2 * | 2/2007 | Johnsgard et al. | 219/444.1 |
| 7,528,070 | B2 * | 5/2009 | Han | 438/682 |
| 7,800,081 | B2 * | 9/2010 | Moffatt et al. | 250/492.2 |
| 7,873,265 | B2 * | 1/2011 | Kitagawa et al. | 392/416 |
| 7,923,933 | B2 * | 4/2011 | Serebryanov et al. | 315/90 |
| 8,106,591 | B2 * | 1/2012 | Serebryanov et al. | 315/91 |
| 8,513,626 | B2 * | 8/2013 | Ramachandran et al. | 250/492.3 |

(Continued)

FOREIGN PATENT DOCUMENTS

| | | |
|---|---|---|
| CN | 1529900 | 9/2004 |
| JP | 2003-059853 | 2/2003 |
| JP | 2005-222962 | 8/2005 |

(Continued)

*Primary Examiner* — Thor Campbell
(74) *Attorney, Agent, or Firm* — Occhiuti & Rohlicek LLP

(57) ABSTRACT

The present invention relates to a heater block for a rapid thermal processing apparatus, and more particularly, to a heater block in which heating lamps are densely arranged in a tessellation. The tessellation has a structure such that the plurality of heating lamps are arranged at right angles to form a zigzag line, and the thus-formed zigzagged line is repeated such that the zigzagged line is combined with the adjacent zigzagged line. According to the present invention, a temperature gradient caused by a void between heating lamps is prevented, and heating lamps are densely arranged to increase heat density for a heat radiation area as opposed to conventional heater blocks, thus achieving improved heat treatment efficiency using less energy. In addition, fully uniform temperature control is enabled, in terms of sector allocated temperature control, even when the area to be independently controlled is enlarged as opposed to conventional heater blocks, thereby simplifying the configuration of a temperature control circuit.

5 Claims, 6 Drawing Sheets

(56) References Cited

U.S. PATENT DOCUMENTS

| | | | | |
|---|---|---|---|---|
| 2001/0027969 | A1 | 10/2001 | Takahashi et al. | |
| 2006/0197454 | A1* | 9/2006 | Mizukawa et al. | 315/46 |
| 2014/0003848 | A1* | 1/2014 | Sakakibara | 399/335 |
| 2014/0045337 | A1* | 2/2014 | Singh et al. | 438/710 |
| 2014/0048529 | A1* | 2/2014 | Pease | 219/494 |

FOREIGN PATENT DOCUMENTS

| | | |
|---|---|---|
| KR | 10-2001-0063341 | 7/2001 |
| KR | 10-0729006 | 6/2007 |

* cited by examiner (a)

side view (b)

bottom view (a)

(b)

HEATER BLOCK FOR A RAPID THERMAL PROCESSING APPARATUS

CROSS REFERENCE TO RELATED APPLICATIONS

This application is a National Stage of International Application No. PCT/KR2010/005119, filed on Aug. 4, 2010, which claims priority to Korean Application No. 10-2009-0077425 filed Aug. 21, 2009. The content of the prior applications are incorporated herein by reference in their entirety.

TECHNICAL FIELD

The present invention relates to a heater block for a rapid thermal processing apparatus, and more particularly, to a heater block which includes heating lamps densely arranged in a tessellated arrangement.

BACKGROUND ART

A rapid thermal processing apparatus heats a substrate at a high rate using infrared light emitted from heating lamps for thermal processing. At this time, various attempts, for example, horizontal rotation of the substrate, have been made to achieve uniform heating of the substrate. However, problems caused by arrangement of heating lamps make it difficult to achieve uniform heating of the substrate, thereby causing a minute temperature gradient on the substrate. Such a temperature gradient provides an increasingly disadvantageous influence on reliability and yield of devices with increasing circuit integration.

FIG. 1 is a bottom view illustrating a conventional concentric arrangement of heating lamps viewed from a lower surface of the heater block 10, that is, from a side of the heater block opposite to a heating target such as a substrate. Referring to FIG. 1, the heater block 10 is provided with a plurality of heating lamps 20. FIG. 2 illustrates a T-shaped heating lamp 28 provided as the heating lamp 20 of FIG. 1. For differentiation, the T-shaped heating lamp is denoted by a different reference numeral than a general heating lamp. As shown in FIG. 2, the T-shaped heating lamp 28 has a T-shape in side view, and a straight rod shape in a bottom view of the heating lamp. In the side view of the heating lamp, an upward protrusion of the T-shaped heating lamp 10 is fitted into the heater block 10 when mounting the T-shaped heating lamp 10 on the heater block 10. Accordingly, when the heater block 10 is viewed from the lower surface thereof, with the T-shaped heating lamp 28 fitted into the heater block 10 as shown in FIG. 1, the T-shaped heating lamp 28 has a straight rod shape. Conventionally, such T-shaped heating lamps 28 are concentrically arranged on the heater block.

However, the concentric arrangement of the heating lamps forms a void in the form of a straight line 21 and a concentric circle 22 as indicated by a dashed dot line, so that a substrate (not shown) is not uniformly heated due to generation of heat overlapping sections and voids between the heat overlapping sections even when the substrate is rotated, thereby causing a minute temperature gradient on the substrate.

FIG. 3 is a bottom view of another conventional concentric arrangement of heating lamps. Even in the concentric arrangement shown in FIG. 3, it is difficult to prevent creation of voids in the form of a straight line 21 and a concentric circle 22.

As described above, the conventional concentric arrangement of the heating lamps inevitably incurs the temperature gradient on the substrate even in the case of horizontally rotating the substrate, and requires a complex structure for sector allocated temperature control, in which the heater block is divided into sectors such that power applied to the heating lamps is adjusted according to the sectors, in order to eliminate the temperature gradient on the substrate.

DISCLOSURE

Technical Problem

Therefore, the present invention is directed to providing a heater block for a rapid thermal processing apparatus, which includes heating lamps densely disposed in a new arrangement manner so as not to form a void between the heating lamps, instead of a conventional concentric arrangement, thereby preventing the occurrence of a temperature gradient caused by the arrangement of the heating lamps.

Technical Solution

In accordance with one aspect of the present invention, a heater block for a rapid thermal processing apparatus includes a plurality of heating lamps for rapidly heating a target in a rapid thermal process, wherein the plurality of heating lamps facing the target is densely arranged in a tessellated arrangement such that a void is not formed between side surfaces of the plural heating lamps facing each other.

Each of the heating lamps may have a straight rod shape on the side surfaces of the heating lamps facing each other.

Each of the heating lamps may be a T-shaped heating lamp which has a protrusion formed in an opposite direction with respect to the target.

The tessellated arrangement may be obtained by repeatedly arranging the plurality of heating lamps to cross each other at a right angle along orthogonal zigzag lines such that adjacent heating lamps are connected at each end thereof to one another. In some embodiments, the plurality of heating lamps may be arranged such that an end surface of a rear end of each of the heating lamps may adjoin a side surface of a leading end of the next heating lamp. In other embodiments, the plurality of heating lamps may be arranged such that a side surface of a rear end of each of the heating lamps may adjoin an end surface of a leading end of the next heating lamp.

Advantagous Effects

According to embodiments of the invention, as compared with conventional heater blocks, the heating lamps are densely arranged to increase heat density per unit heat radiation area, thereby providing improved heat treatment efficiency with less energy while preventing the occurrence of a temperature gradient caused by a void between the heating lamps. In addition, uniform temperature control is enabled in the structure for sector allocated temperature control, even when the sectors to be independently controlled have increased areas as compared with a conventional heater block, thereby simplifying the configuration of a temperature control circuit.

BEST MODE

Exemplary embodiments of the present invention will now be described in detail with reference to the accompanying drawings. The following embodiments are given by way of illustration only and various modifications will be apparent to a person having ordinary knowledge in the art without departing from the scope of the invention. Therefore, it should be understood that the following embodiments are not to be in any way construed as limiting the scope of the invention.

Figure 4:
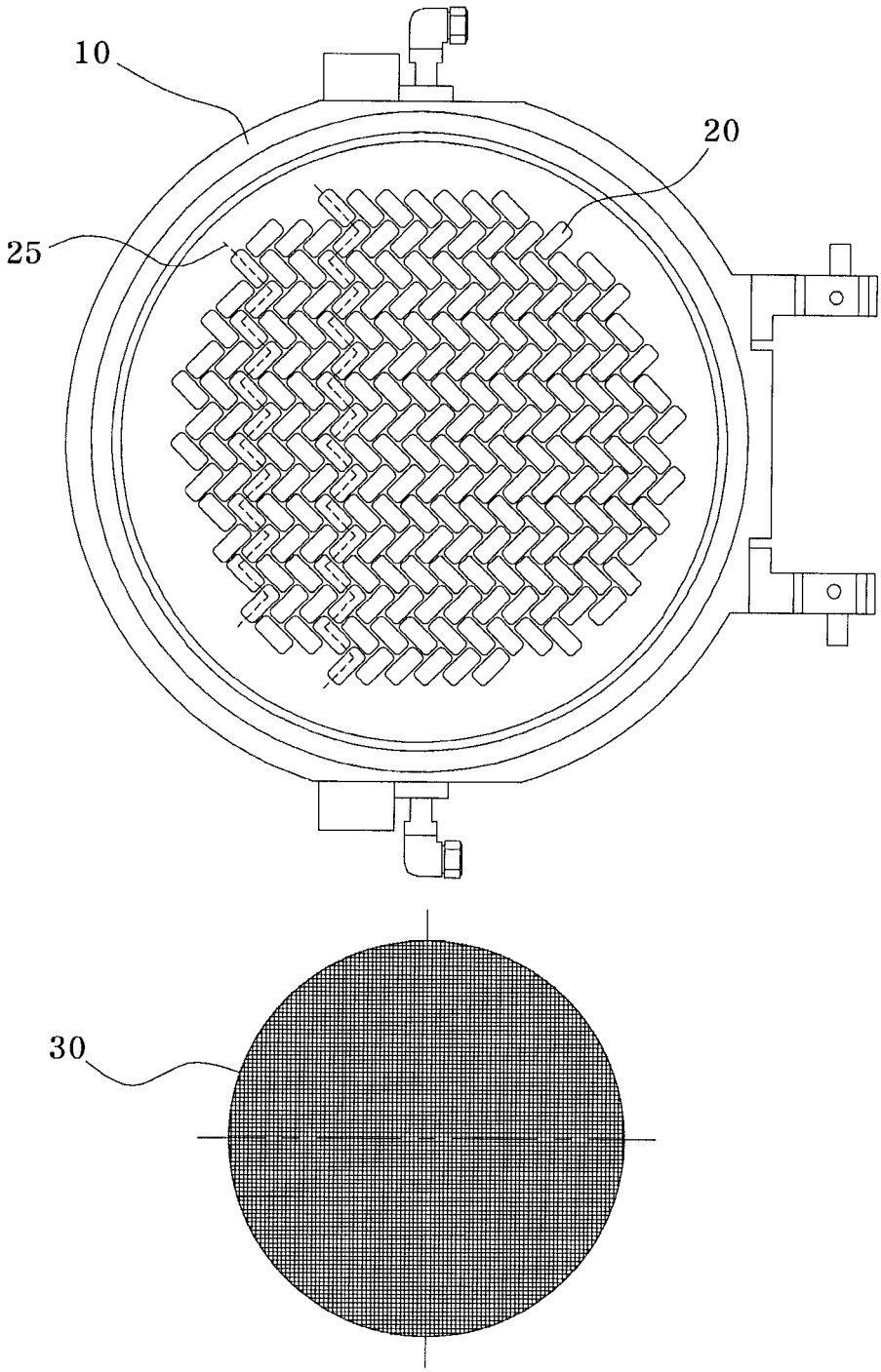
FIG. 4 and FIG. 5 are views of a tessellated arrangement of heating lamps of a heater block according to one exemplary embodiment of the present invention.
Figure 5:
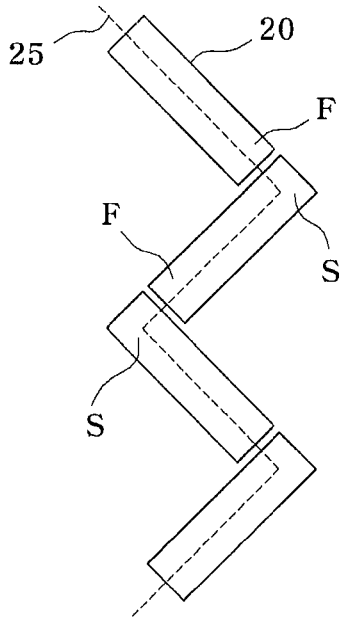
Figure 5:
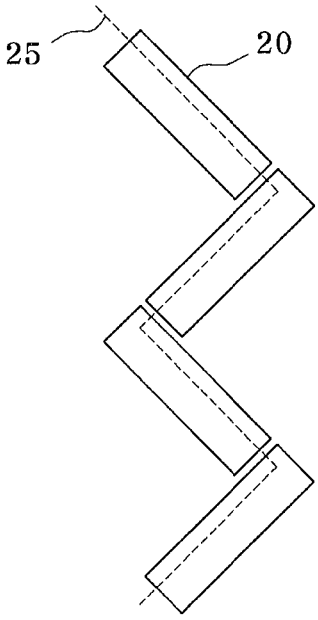

FIG. 4 and FIG. 5 are views of a tessellated arrangement of heating lamps of a heater block according to one exemplary embodiment of the present invention. In this embodiment, heating lamps are densely disposed in a tessellated arrangement, instead of a conventional concentric arrangement, such that the lower surface of the heater block 10 is completely filled with the heating lamps without forming a void between the heating lamps.

Figure 1:
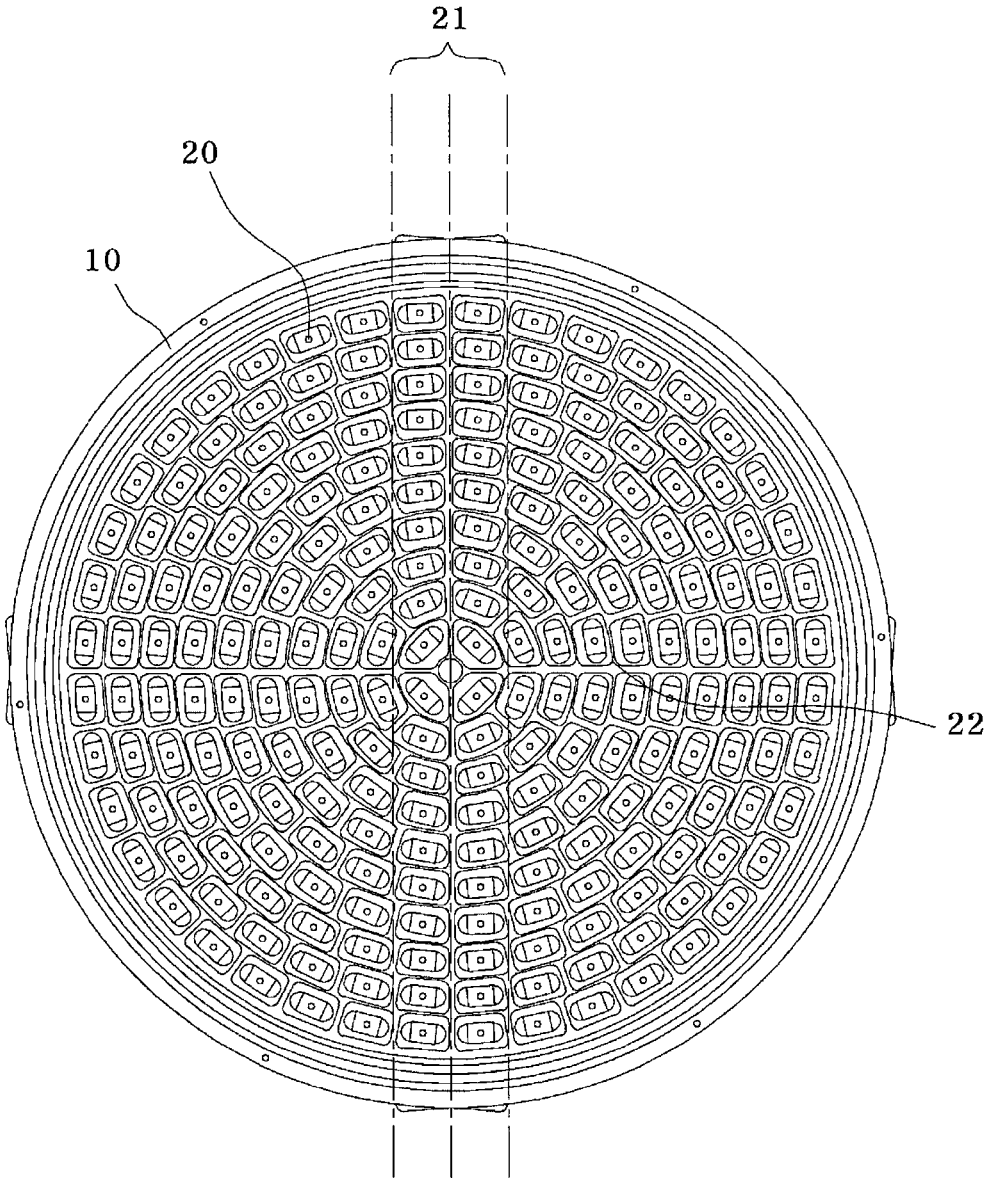
Fig. 1 (Prior Art)
FIG. 1 is a bottom view illustrating conventional concentric arrangement of heating lamps.
Figure 2:
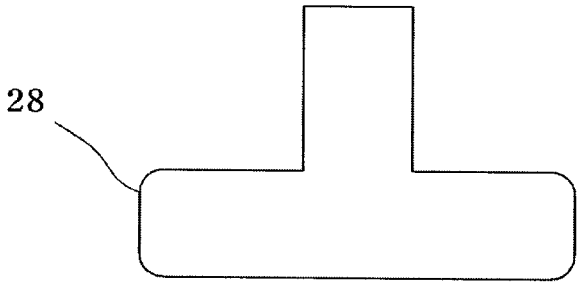
Fig. 2 (Prior Art)
FIG. 2 illustrates a T-shaped heating lamp 20 of FIG. 1.
Figure 2:
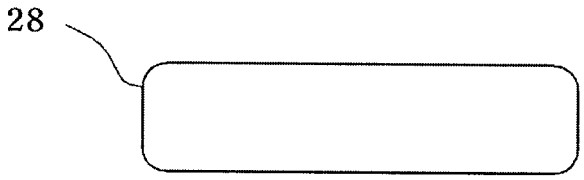
Fig. 2 (Prior Art)
Figure 3:
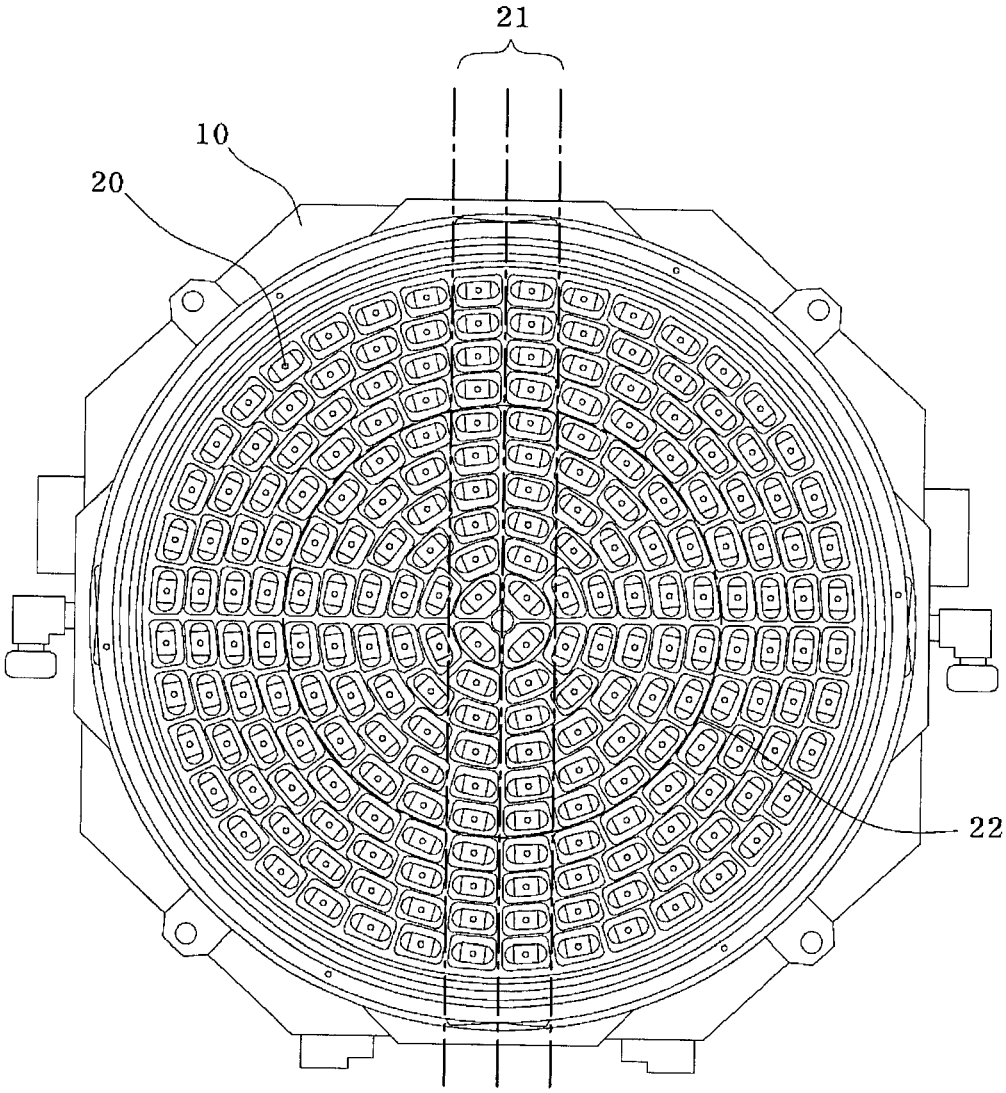
Fig. 3 (Prior Art)
FIG. 3 is a bottom view of another conventional concentric arrangement of heating lamps.

The term "tessellated arrangement" refers to the act of positioning planar figures close to each other so as not to overlap each other. According to this invention, since the heater block employs the heating lamps 20 having a straight rod shape in a bottom view, that is, when viewed from a substrate as a heating target, the term tessellated arrangement means that rectangular members are disposed on the lower surface of the heater block so as not to overlap each other without forming a void therebetween. Obviously, it is not necessary for the heating lamps to have a straight rod shape in the bottom view to provide such a tessellated arrangement. In this embodiment, the heating lamp has a straight rod shape for convenience of arrangement, and, in this structure, a T-shaped heating lamp as illustrated in FIG. 2 may be used as the heating lamp.

The heating lamp 20 has a rectangular shape with two ends S and F, as seen in a bottom view of the heating lamp. Herein, the tessellated arrangement refers to repeated arrangement of the heating lamps 20 to cross each other at a right angle along orthogonal zigzag lines 25 such that adjacent heating lamps are connected at each end thereof to one another, as shown in FIG. 5.

FIG. 5(*a*) shows one embodiment of the tessellated arrangement, in which an end surface of a rear end F of each of the heating lamps adjoins a side surface of a leading end S of the next heating lamp, with the heating lamps disposed along orthogonal zigzag lines 25. FIG. 5(*b*) shows another embodiment of the tessellated arrangement, in which a side surface of a rear end F of each of the heating lamps adjoins an end surface of a leading end S of the next heating lamp, with the heating lamps disposed along orthogonal zigzag lines 25.

Figure 6:
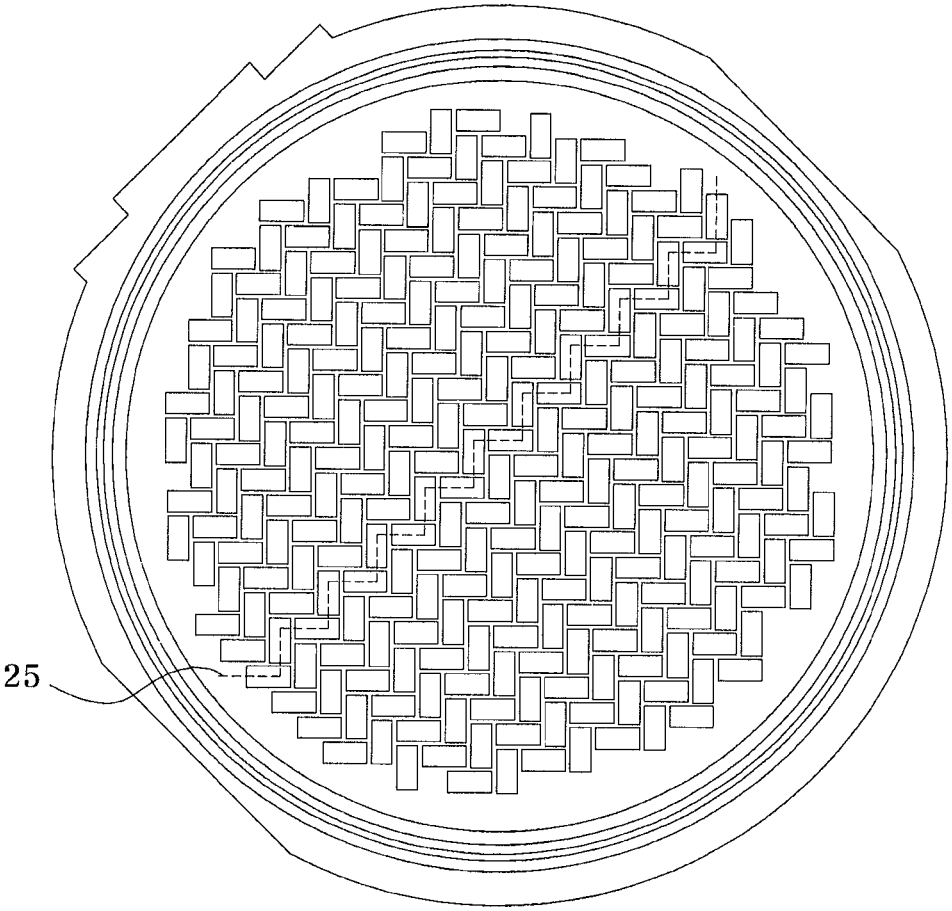
FIG. 6 is a view of a tessellated arrangement of heating lamps of a heater block according to another exemplary embodiment of the present invention.

FIG. 4 shows that the orthogonal lines are vertically arranged, and FIG. 6 shows that the orthogonal lines are diagonally arranged.

When the rectangular heating lamps are disposed in the tessellated arrangement as shown in FIGS. 4 and 6, it is possible to fill the lower surface of the heater block 10 with the heating lamps 20 without a void between the heating lamps.

As described above, according to the embodiment of the invention, the heater block includes the heating lamps 20 densely disposed thereon to have an increased thermal density per unit heat radiation area, thereby providing improved heat treatment efficiency while preventing the occurrence of a temperature gradient on the substrate 30, which could be caused by a void between the heating lamps. In addition, with the structure for sector-allocated temperature control, the heater block enables uniform temperature control even when the sectors to be independently controlled have increased areas, thereby simplifying a temperature control circuit.

The invention claimed is:

1. A heater block for a rapid thermal processing apparatus including a plurality of heating lamps for rapidly heating a target in a rapid thermal process, wherein the plurality of heating lamps facing the target is densely arranged in a tessellated arrangement such that a void is not formed between side surfaces of the plural heating lamps facing each other, and the tessellated arrangement is obtained by repeatedly arranging the plurality of heating lamps to cross each other at a right angle along orthogonal zigzag lines such that adjacent heating lamps are connected at each end thereof to one another.

2. The heater block of claim 1, wherein each of the heating lamps has a straight rod shape on the side surfaces of the heating lamps facing each other.

3. The heater block of claim 2, wherein each of the heating lamps is a T-shaped heating lamp which has a protrusion formed in an opposite direction with respect to the target.

4. The heater block of claim 1, wherein the heating lamps are arranged to cross each other at a right angle along the orthogonal zigzag lines, such that an end surface of a rear end of each of the heating lamps adjoins a side surface of a leading end of the next heating lamp.

5. The heater block of claim 1, wherein the heating lamps are arranged to cross each other at a right angle along the orthogonal zigzag lines such that a side surface of a rear end of each of the heating lamps adjoins an end surface of a leading end of the next heating lamp.

* * * * *